United States Patent [19]

Gulla

[11] 3,936,316

[45] *Feb. 3, 1976

[54] PICKLING SOLUTION

[75] Inventor: Michael Gulla, Newton, Mass.

[73] Assignee: Shipley Company, Inc., Newton, Mass.

[ * ] Notice: The portion of the term of this patent subsequent to May 16, 1989, has been disclaimed.

[22] Filed: Nov. 29, 1972

[21] Appl. No.: 310,371

[52] U.S. Cl. ..... 134/3; 134/41; 252/79.1; 252/148; 252/392

[51] Int. Cl.[2] ..... C23G 1/02; C09K 13/06

[58] Field of Search ..... 134/3, 41; 252/79.1, 79.2, 252/79.3, 79.4, 392, 148; 21/2.7 R; 156/14

[56] References Cited

UNITED STATES PATENTS

| | | | |
|---|---|---|---|
| 2,177,751 | 10/1939 | Sikorski | 252/79.4 |
| 2,485,529 | 10/1949 | Cardwell et al. | 252/149 |
| 3,009,849 | 11/1961 | Bellinger | 252/79.4 |
| 3,595,799 | 7/1971 | Peterson | 134/3 X |
| 3,655,571 | 4/1972 | Tedeschi et al. | 252/392 X |
| 3,663,441 | 5/1972 | Gulla | 252/79.4 |
| 3,788,914 | 1/1974 | Gumbelevicius | 252/79.4 X |

FOREIGN PATENTS OR APPLICATIONS

| | | | |
|---|---|---|---|
| 1,024,620 | 3/1966 | United Kingdom | 252/79.4 |

OTHER PUBLICATIONS

Monsanto, Application Data Bulletin No. 108 – Hibitite and Inhibited Acids, 3/30/39, pp. 3–7, Printed 1/36.

*Primary Examiner*—Joseph Scovronek
*Assistant Examiner*—Arnold Turk
*Attorney, Agent, or Firm*—Robert L. Goldberg

[57] ABSTRACT

The invention is for a process and composition for pickling metals, especially iron based metals, prior to metal finishing. A hydrohalide acid pickling solution is used which solution is characterized by the addition of urea. The urea substantially reduces, even completely eliminates, the excessive liberation of noxious and corrosive hydrohalide acid fumes normally associated with such pickling operations. This is an advantage as it greatly reduces the cost of the pickling operation as the consumption of acid is dramatically reduced. Moreover, there is less injury to personnel and equipment contacted with said fumes. Finally, a metal surface treated with the pickling solution of the invention is improved as there is less pitting and the surface is more active to a metal depositing solution.

23 Claims, 3 Drawing Figures

PICKLING SOLUTION

BACKGROUND OF THE INVENTION

1. Introduction

This invention relates to a process for pickling metals in acid baths to prepare the surface for a further finishing operation such as metal plating, electrolessly or electrolitically, painting and the like, and more particularly, to pickling metals with hydrohalide acid solutions, particularly hydrochloric acid solutions.

2. Description of the prior art.

Sulfuric acid is the acid which is used in the largest quantities for the pickling of metals because of its low cost. However, the art has recently turned to hydrohalide acids, particularly hydrochloric acid, because of difficulties associated with the disposal of spent sulfuric acid solutions and various advantages associated with the use of the hydrohalide acids such as faster pickling rate at room temperature, better solubility for various types of rust and scale, superior surface conditions of the pickled part and finally, the acid which remains on the surface of the part is both less in volume due to a lower viscosity and more easily removed from the surface of the part by rinsing. The subject of hydrohalide acid pickling of iron and steel is discussed in detail by Max Straschill, *Pickling of Metals*, Robert Draper, Lmtd. Teddington, England, 1963, pages 42 to 44 incorporated herein by reference. The pickling of other metals with hydrohalide acids is disclosed in the Metal Finishing Guidebook Directory for 1972, Metal and Plastics Publications, Westwood, N.J., pp. 206 to 214, also incorporated herein by reference.

Though the art is turning to hydrohalide acids for pickling, there are certain disadvantages associated with their use. At the concentration at which the acid is used, there is substantial evolution of gas even at room temperature and considerable fuming in moist air due to the formation of hydrohalide acid mist. As well as possessing a sharp odor, these fumes attack the human respiratory organs and mucous membranes and are corrosive to steel and other metal parts with which they come into contact. Moreover, this fuming results in a large loss of acid substantially increasing the cost of the overall pickling procedure. Finally, the excessive fuming limits the pickling process to a room temperature process as increased temperatures cause even greater fuming. Room temperature operation results in a slower pickling rate. Moreover, because the pickling operation is exothermic, cooling equipment was required further adding to cost.

Attempts have been made in the prior art to reduce cost using hydrohalide acids by providing systems for the recovery of spent solutions. The recovery of hydrochloric acid from the spent pickling liquors used for the pickling of iron based metals is discussed in detail in articles by Perkins et al and Pool, *Iron and Steel Engineer*, April, 1965, pages 156 to 163, incorporated herein by reference. According to said publication, the high cost associated with the use of hydrochloric acid as a pickling solution is in part compensated for by the economy associated with the recovery system. Thus, the chloride salt formed during a pickling operation is recovered and decomposed thermally with almost complete recovery of the chloride ion which is used for the formation of reusable hydrochloric acid. This feature of the process enables hydrochloric acid to compete with sulfuric acid despite its high cost.

Even with the above described recovery process, the pickling operation is still expensive because of the excessive fuming of the acid during the pickling operation and the resultant loss thereof. The acid lost in this manner cannot be recovered and converted back to reusable hydrochloric acid.

In U.S. Pat. No. 3,423,240 incorporated herein by reference, there is taught a modification of the hydrochloric acid recovery system shown by Perkins et al which is stated to further improve the economy of the operation. According to said patent, the overall economy is improved by a modification comprising the use of extra chloride ion in the pickling bath in the form of a salt such as sodium chloride to compensate for losses in the system. The addition of the sodium chloride to the pickling solution accompanied by at least a stoichiometric amount of a sulphur containing substance capable of reacting with sodium chloride, oxygen and water vapor to produce hydrogen chloride and sodium sulphate is said to result in an almost quantitative conversion of the sodium chloride to hydrogen chloride. In plants operating both hydrochloric acid pickling lines and sulfuric acid pickling lines, the waste sulfuric acid pickling solution is an ideal source of the sulphur containing material. In situations where sulfuric acid pickling solutions are not readily available, recourse can be had to many other economical, commercially available sources of reactive sulphur.

Though the above procedure does make the overall process of pickling with hydrochloric acid and other hydrohalide acids more economical, it is still not as economical as might be desired because there is still an excessive loss of acid by fuming, thereby increasing the cost of the operation, attacking steel equipment and more importantly, presenting a health hazard due to attack on the respiratory system.

SUMMARY OF THE INVENTION

The subject invention provides a hydrohalide acid pickling solution, preferably a hydrochloric acid pickling solution, especially useful for iron based metals which solution is safer, more effective and more economical to use than hydrohalide pickling solution of the prior art. The invention is predicated upon the discovery that the addition of urea in sufficient quantity to a hydrohalide acid pickling solution substantially reduces, even completely eliminates, the fuming associated with the use of such solutions. Accordingly, the hydrohalide acid is not lost by fuming and there is a corresponding decrease in consumption of hydrohalide acid during a pickling operation. As a result, with the recovery system for the spent pickling solution described above and the elimination of fuming, the subject invention provides a hydrohalide acid pickling solution that is safe to use and at least economically competitive with sulfuric acid.

In addition to the advantages noted above, there are additional advantages to the invention described herein. For example, the pickling solution can be used at elevated temperature without fuming thereby obtaining increased pickling rate and further reducing costs as cooling equipment is not necessary. Also, for reasons not fully understood, the surface of a part treated with the solutions of this invention are less pitted and more active to a metal depositing solution than parts treated with pickling solutions of the prior art.

DESCRIPTION OF THE PREFERRED EMBODIMENTS

Figure 1:
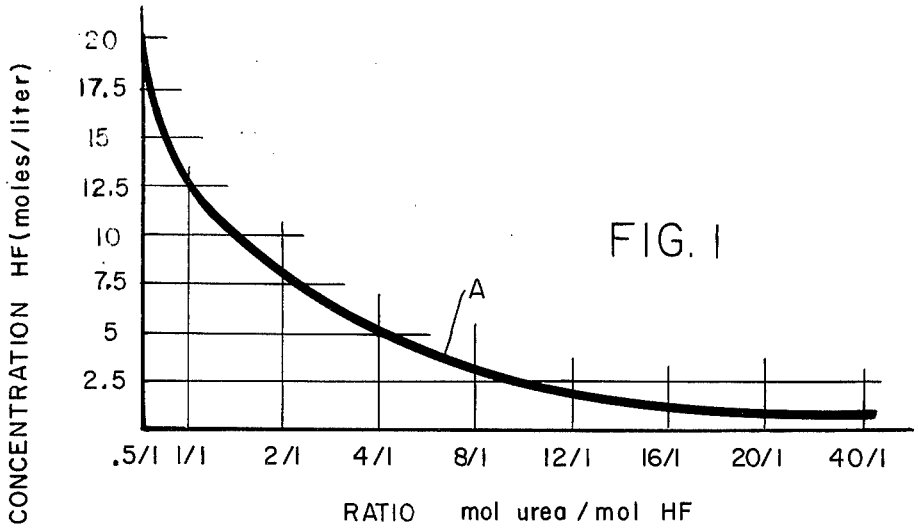
FIG. 1 represents graphically the relationship between hydrofluoric acid content in a pickling solution as a function of the ratio of urea to acid.

The term "pickling solution" as used herein is defined as a solution for removing dirt, scale, oxide, rust and the like from the surface of a metal as well as a solution to remove metal by dissolution thereof.

The term "hydrohalide acid pickling solution" as used herein is intended to mean hydrochloric acid, hydrofluoric acid and to a limited extent, hydrobromic acid as used in the prior art for the pickling of metals. Consequently, the term is intended to include within its scope acid solutions used in concentrations as used in the prior art except as discussed below, and containing additives such as surfactants, inhibitors, cleaners and the like as used in the prior art. The pickling solutions of the invention are used to pickle the same metals as the hydrohalide acid solutions of the prior art. Typical metals include iron based metals, aluminum, copper, nickel and its alloys, titanium, zirconium and the like.

Hydrofluoric acid is fully soluble in water and is itself a liquid. It is commercially available as a 20N solution (20 moles per liter of solution) and is used at about one-half this strength for the pickling of metals. Its most important property, which distinguishes it from other pickling solutions, is its ability to dissolve hydrosilic acid and its salts. For this reason, hydrofluoric acid is particularly suitable for pickling sand castings. Fine particles of sand that remain in the recesses of a surface, which cannot be removed by mechanical methods or other pickling solutions, are readily removed with the aid of hydrofluoric acid.

Hydrochloric acid is the most commonly used pickling acid of the hydrohalide acids. It is commercially available as a 12N solution (12 moles per liter) though 3N to 6N solutions are typically used for pickling of metals, especially iron based metals.

Hydrobromic acid, because of high cost, is rarely used for pickling of metals, but to the extent that it is used, is within the scope of this invention. Concentrated hydrobromic acid commercially available is about 5N (5 moles per liter) and is used for pickling in strengths of about 3N.

For purposes set forth herein the acid concentration is at least 0.5 moles per liter as lower concentrations will not provide a satisfactory etch rate. The maximum concentration is as set forth in FIGS. 1–3 as will be discussed in greater detail below.

Urea is added to the hydrohalide solution in an amount at least sufficient to reduce fuming and preferably sufficient to substantially totally eliminate fuming. Though not wishing to be bound by theory, it is believed that an adduct of urea and the hydrohalide acid is formed that requires at least one mole of urea for each mole of the hydrohalide acid. Consequently, fuming is reduced by the addition of urea to the hydrohalide acid solution in amounts less than 1 mole per mole of hydrohalide acid as some adduct is formed and is substantially eliminated when used in larger amounts, e.g., in excess of one mole of urea per mole of hydrohalide acid which constitutes a preferred minimum concentration.

There is an upper limit on the amount of urea that can be added to the acid solution. This is due to the fact that the urea in solution substantially adds to the volume. Every gram of urea in solution substantially adds about 0.75 milliliters to volume. Consequently, this limits the maximum concentration of acid that may be used since the volume occupied by the urea serves to dilute the acid.

Figure 2:
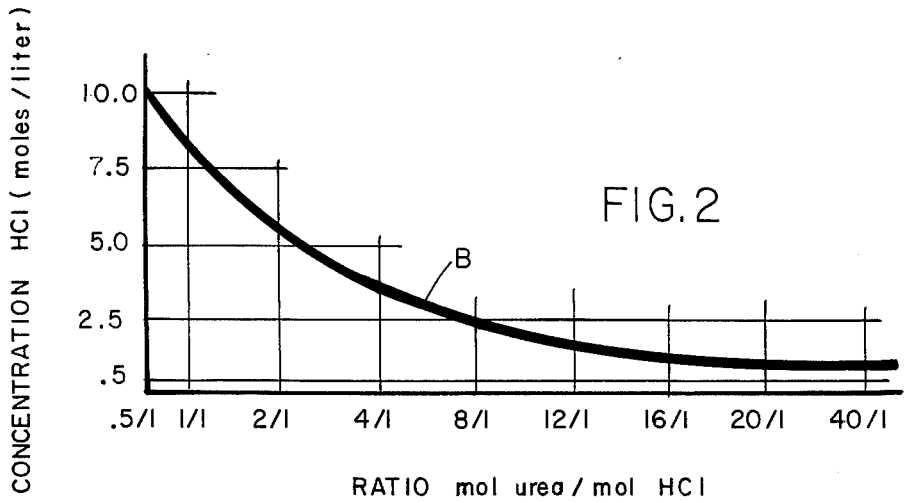
FIG. 2 is similar to FIG. 1, but for hydrochloric acid.
Figure 3:
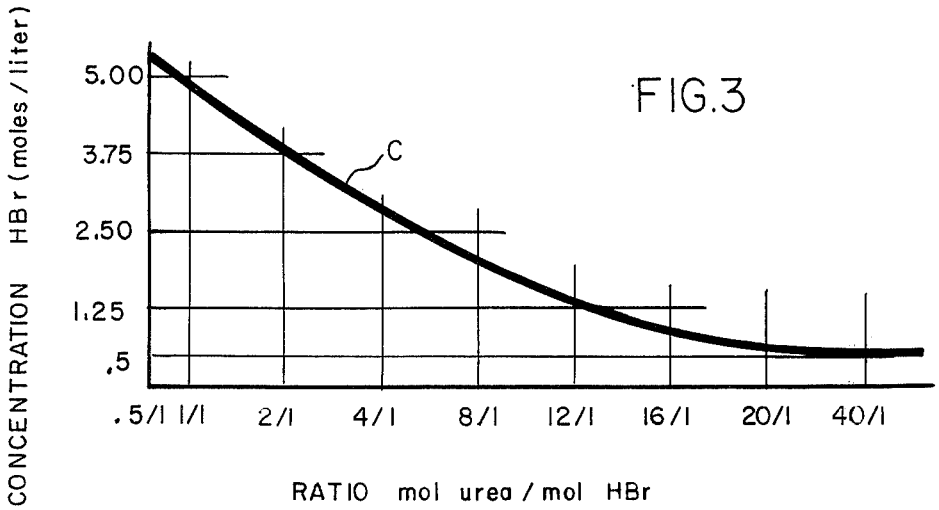
FIG. 3 is also similar to FIG. 1, but for hydrobromic acid.

The relationship between the ratio of urea and acid as a function of maximum acid concentration is set forth in FIGS. 1 to 3 of the drawing. With reference to FIG. 1 first, there is set forth the curve showing maximum concentration of hydrofluoric acid (based upon commercially available concentrated hydrofluoric acid) as a function of the mole ratio of urea to hydrofluoric acid. It can be seen that as the ratio increases, and more urea is added to solution thus occupying a greater volume, the maximum concentration of the acid decreases. It should be understood that the entire area under the curve represents formulations within the scope of the invention and that the curve itself merely represents the maximum concentration of acid at any given urea to acid ratio. As noted above, the minimum concentration of acid practical for purposes set forth herein is usually 0.5 moles of acid per liter. The maximum concentration is as represented by the curve in FIG. 1. Preferably, for hydrofluoric acid, the ratio of urea to hydrofluoric acid is at least 1 to 1 and more preferably varies between 2 to 1 and 16 to 1. Most preferably, the ratio varies between 4 to 1 and 8 to 1 while the concentration of acid varies between 2.5 moles per liter of solution and the maximum represented by the curve within the boundaries set forth by the ratio limitations.

The relationship between concentration of acid and ratio of urea to acid for hydrochloric acid and hydrobromic acid (based upon commercially available concentrated solutions) is quite similar to that for hydrofluoric acid. As with hydrofluoric acid, the minimum concentration for hydrochloric acid is 0.5 moles of acid per liter of solution and the maximum concentration is as represented by the curve in FIG. 2. Preferably, for hydrochloric acid, the ratio of urea to acid is at least 1 to 1 and more preferably varies between 2 to 1 and 10 to 1. Most preferably, the ratio varies between 2 to 1 and 6 to 1 while the concentration of acid varies between 2.5 moles per liter of solution and the maximum represented by the curve within the boundaries set forth by the curve within the boundaries set forth by the ratio limitations.

For hydrobromic acid, the relationship between acid concentration and ratio of urea to acid is set forth in FIG. 3. Again, the minimum concentration of acid is 0.5 moles per liter and the maximum is as set forth in FIG. 3. The preferred ratio of urea to acid is at least 1 to 1 and more preferably varies between 2 to 1 and 8 to 1. Most preferably, the ratio varies between 2 to 1 and 5 to 1 while the concentration of acid most preferably varies between 2.5 moles per liter of solution and the maximum represented by the curve within the boundaries set forth by the ratio limitations.

As noted above, the pickling solutions of this invention are capable of use at temperatures higher than solutions of the prior art. In this respect, the solutions are operative at room temperature, but may be used at temperatures up to just below the boiling point of the solution. Consequently, the temperature of the solution may vary between about 70° and 210°F, preferably varies between 110° and 180°F and most preferably, varies between about 125° and 165°F, especially since the urea provides somewhat of an inhibiting effect on the acid.

The pickling solutions of this invention are used in the same manner as the pickling solutions of the prior art. Consequently, immersion time of a part in the pickling solution may vary between about 1 and 10 minutes dependent upon the particular metal pickled, the pickling temperature and other factors known to those skilled in the art.

Example

| | |
|---|---|
| Hydrochloric acid (concentrated) | 200 ml |
| Urea | 200 grams |
| Citric acid | 10 grams |
| Surfactant | 5 grams |
| Water | to 1 liter |

In the above formulation, the hydrochloric acid is present in solution in a concentration of about 2.5 moles per liter and the urea is present in an amount of about 3.3 moles per liter. The citric acid in solution serves as a chelating agent for extraneous ions.

Mild steel was immersed in the above formulation maintained at 160°F for 4 minutes. Upon removal of the steel and rinsing with cold water, a smooth, matted surface was evident. Microscopic examination failed to reveal pits. The steel was then metal plated electrolessly in conventional manner with nickel using an electroless nickel plating solution identified as NL-61 which comprised a nickel salt, hypophosphite as a reducing agent therefore and proprietary complexing agents. The mild steel was highly active to the catalytic deposition of nickel and a smooth, coherent layer of nickel was obtained.

Throughout the pickling operation, there was no odor of hydrochloric acid whatsoever and no fumes of hydrochloric acid could be detected if the air immediately over the pickling solution was inhaled.

The procedure of the above example was repeated using Korvar in place of the mild steel and a 314 stainless steel with similar results. For the stainless steel, the pickling time was increased to 8 minutes.

The above example can be repeated with a pickeling solution at a temperature of both 75°F and 120°F with similar results though the pickling time is increased as the temperature decreases.

The procedure of the above example was repeated five times with varying concentration of urea as follows:

0 grams per liter, 50 grams per liter, 100 grams per liter, 200 grams per liter and 400 grams per liter. Heavy fuming was encountered with the formulation containing no urea while no fuming whatsoever was detected using the formulations containing 200 and 400 grams per liter of urea respectively. Fuming was evident with the solution containing 50 grams per liter of urea, but was somewhat reduced compared to the solution containing no urea. Finally, the formulation containing 100 grams per liter did fume, but in an amount substantially less than that solution containing no urea.

The above five formulations were used to pickle steel and all behaved in a similar manner. The pickled surface was best with those solutions containing 200 and 400 grams per liter of urea, respectively.

The procedure of the example can be repeated with the following formulations:

| | | |
|---|---|---|
| A. | Hydrofluoric acid (concentrated) | 100 ml |
| | Urea | 240 grams |
| | Citric acid | 10 grams |
| | Surfactant | 5 grams |
| | Water | to 1 liter |
| B. | Hydrobromic acid (concentrated) | 100 ml |
| | Urea | 300 grams |
| | Citric acid | 10 grams |
| | Surfactant | 5 grams |
| | Water | to 1 liter |

Similar results to those set forth above are obtained.

I claim:

1. A hydrohalide acid pickling solution consisting essentially of an aqueous solution of a hydrohalide acid, selected from the group consisting of hydrochloric acid and hydrobromic acid, in an amount of at least 0.5 moles per liter of solution and urea in an amount of at least 0.5 moles per mole of acid and sufficient to substantially reduce fuming of said acid.

2. The pickling solution of claim 1 where the concentration of urea is at least 1 mole per mole of acid.

3. The pickling solution of claim 2 where the acid is hydrochloric acid in a concentration of at least 0.5 moles per liter and the mole ratio of urea to acid varies between 2/1 and a maximum for a given concentration of acid, the given concentration being taken on the ordinate, the maximum mole ratio being found at the intersection of the horizontal line for the given concentration of acid, as depicted in FIG. 2 of the drawings along line B.

4. The pickling solution of claim 3 where the urea concentration varies between 2 moles of urea per mole of acid and 10 moles of urea per mole of acid.

5. The pickling solution of claim 3 where the urea concentration varies between 2 moles of urea per mole of acid and 6 moles of urea per mole of acid.

6. The pickling solution of claim 5 where the minimum concentration of acid is at least 2.5 moles per liter of solution.

7. The pickling solution of claim 2 where the acid is hydrobromic acid in a concentration of at least 0.5 moles per liter and the mole ratio of urea to acid varies between 2/1 and a maximum for a given concentration of acid, the given concentration being taken on the ordinate, the maximum ratio being found at the intersection of the horizontal line for the given concentration of acid, as depicted in FIG. 3 of the drawings along line C.

8. The pickling solution of claim 7 where the urea concentration varies between 2 moles of urea per mole of acid and 8 moles of urea per mole of acid.

9. The pickling solution of claim 7 where the urea concentration varies between 2 moles of urea per mole of acid and 5 moles of urea per mole of acid.

10. The pickling solution of claim 9 where the minimum concentration of acid is 2.5 moles per liter of solution.

11. In a process for pickling a metal comprising the step of contacting said metal with a hydrohalide acid pickling solution consisting essentially of a hydrohalide acid, selected from the group consisting of hydrochloric acid and hydrobromic acid, where said acid is present in an amount of at least 0.5 moles per liter of solution, the improvement comprising the addition of urea to said hydrohalide acid in an amount of at least 0.5 moles per mole of acid and sufficient to substantially reduce fuming of said acid.

12. The process of claim 11 where the metal is an iron based metal.

13. The process for pickling of claim 11 where the concentration of urea is at least 1 mole per mole of acid.

14. The process for pickling of claim 13 where the temperature of the pickling solution varies between 70° and 210°F.

15. The process for pickling of claim 13 where the temperature of the pickling solution varies between 125° and 165°F.

16. The process of pickling of claim 13 where the acid is hydrochloric acid in a concentration of at least 0.5 moles per liter and the maximum mole ratio of urea to acid for a given concentration of hydrochloric acid is depicted in FIG. 2 of the drawings along line B, the given concentration being taken on the ordinate, the maximum mole ratio being found at the intersection of the horizontal line for the given concentration of acid.

17. The process for pickling of claim 16 where the urea concentration varies between 2 moles of urea per mole of acid and 10 moles of urea per mole of acid.

18. The process for pickling of claim 16 where the urea concentration varies between 2 moles of urea per mole of acid and 6 moles of urea per mole of acid.

19. The process for pickling of claim 18 where the minimum concentration of acid is at least 2.5 moles per liter of solution.

20. The process of pickling of claim 13 where the acid is hydrobromic acid in a concentration of at least 0.5 moles per liter and the maximum mole ratio of urea to acid for a given concentration of hydrobromic acid is depicted in FIG. 3 of the drawings along line C, the given concentration being taken on the ordinate, the maximum mole ratio being found at the intersection of the horizontal line for the given concentration of acid.

21. The process for pickling of claim 20 where the urea concentration varies between 2 moles of urea per mole of acid and 8 moles of urea per mole of acid.

22. The process for pickling of claim 20 where the urea concentration varies between 2 moles of urea per mole of acid and 5 moles of urea per mole of acid.

23. The process for pickling of claim 22 where the minimum concentration of acid is 2.5 moles per liter of solution.

* * * * *